United States Patent [19]

Bean

[11] 4,216,872

[45] Aug. 12, 1980

[54] TAMPER-PROOF CONTAINER

[75] Inventor: John R. H. Bean, Brighton, Australia

[73] Assignee: Brickwood Holdings Proprietary Limited, Cheltenham, Australia

[21] Appl. No.: 2,562

[22] Filed: Jan. 11, 1979

[30] Foreign Application Priority Data

Aug. 28, 1978 [AU] Australia ..... 5692/78

[51] Int. Cl.[2] ..... B65D 41/32

[52] U.S. Cl. ..... 215/253; 220/270; 215/320

[58] Field of Search ..... 215/253, 256, 252; 220/276, 270, 320

[56] References Cited

U.S. PATENT DOCUMENTS 3,462,035 8/1969 Grussen ..... 215/253

3,780,897 12/1973 Wassilieff ..... 215/320

3,899,097 8/1975 Aichinger ..... 215/320

FOREIGN PATENT DOCUMENTS 2212297 9/1973 Fed. Rep. of Germany ..... 215/253

*Primary Examiner*—Herbert F. Ross

*Attorney, Agent, or Firm*—Wigman & Cohen

[57] ABSTRACT

A tamper-proof container closure which has a tear strip concentric with the dependent side walls of the cap. The tear strip which is spaced apart from the cap side walls is connected to the side walls by frangible radial connections. The tear strip is adapted to seat on a shoulder of the container on which the cap is fitted and the closure can only be removed from the container by first removing the tear strip.

3 Claims, 6 Drawing Figures

TAMPER-PROOF CONTAINER

This invention relates to tamper-proof closures for containers, particularly for plastic containers for liquid foodstuffs.

Tamper-proof closures are required to ensure that consumers can readily identify if the closure or cap of a container has been opened. Generally, such closures cannot be removed from the container unless a portion of the cap is torn or removed. Prior designs of tamper-proof caps, although achieving the above objects, have proved difficult to use insofar as positioning the cap onto the container is concerned. Also, prior art tamper-proof closures have tended to be complex in shape so that expensive production methods were involved in producing them.

It is an object of this invention to provide a simple closure for containers which can be applied by conventional cap applicators and produces by simple injection moulding techniques.

To this end, the present invention provides a tamper-proof container comprising a container body having a neck portion, said neck portion incorporating an opening, a peripheral lip about said opening, a recessed portion below said lip, and a shoulder portion forming the base of said recess and extending beyond the extremity of said lip; and a closure for said container body comprising a top portion adapted to cover said opening, a first dependent side wall portion adapted to extend over said lip, a beading on said side wall portions adapted to seat in said recess and a second wall portion detachably secured to said first side wall, spaced therefrom and concentric therewith, said second wall portion seating on said shoulder portion. The container closure is a snap fit onto the container. The presence of the outer wall portion seated on the shoulder of the container renders it impossible to remove the closure without rupturing the severable connections between the dependent side wall and the outer wall portion. Generally, the connection can be broken by flexing the outer wall portion.

One advantage of this invention is that the cap can be applied as a snap-on cap on lightweight plastic bottles using a so-called "Ford Capping Station" that is standard on many conventional high speed rotary dairy and juice filling lines where an aluminum foil cap is usually applied. The relatively simple design of the closures of the present invention makes the production costs therefor less than other alternatives known in the art.

Another advantage of the cap design of this invention is that the caps do not nest within one another during automatic feeding of the caps prior to their being placed onto the filled bottles. If nesting occurs, difficulty is encountered in separating the caps and this can lead to loss of production time during the filling of the bottles.

A preferred form of the invention is shown in the attached drawings.

The closure 11 includes a top portion and a dependent side wall portion and an outer wall portion 12 connected to the side wall portion by severable connecting links 13.

The closure 11 incorporates a flange 15 dependent from its top portion and concentric with the first side wall portion such that the lip of the opening of the container to which closure 11 is applied is wedged between the flange 15 and the first dependent wall portion.

Figure 1:
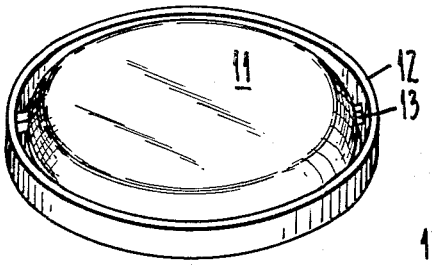
FIG. 1 is a perspective view from above of a closure cap for a plastic cream bottle.
Figure 2:
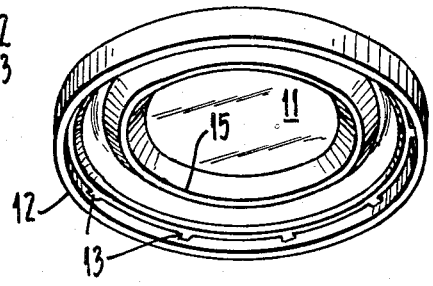
FIG. 2 is a perspective view from below of such a cap.
Figure 3:
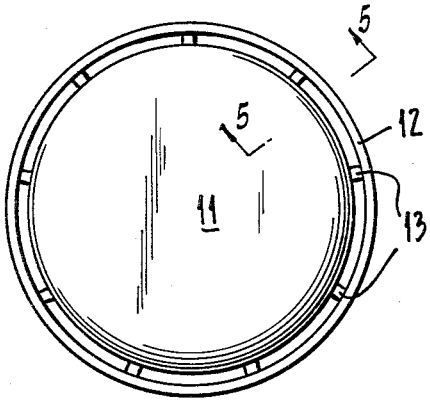
FIG. 3 is a plan view of the closure cap from above.
Figure 4:
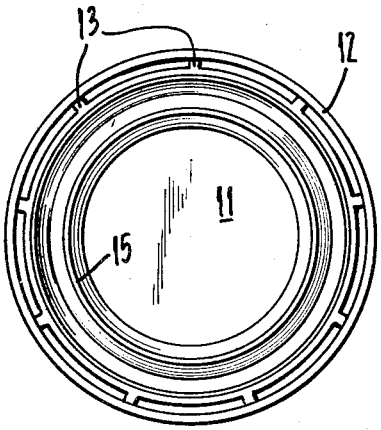
FIG. 4 is an underneath plan view of the cap.
Figure 5:
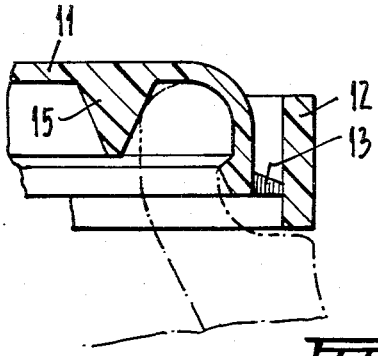
FIG. 5 is an enlarged cross sectional view of the cap attached to a container (which is shown by dotted lines)

The side wall portion of the closure 11 also includes an internal beading which seats below the corresponding lip portion of the container. The outer wall 12 seats on the outer periphery of the corresponding shoulder of the container as shown in FIG. 5.

Figure 6:
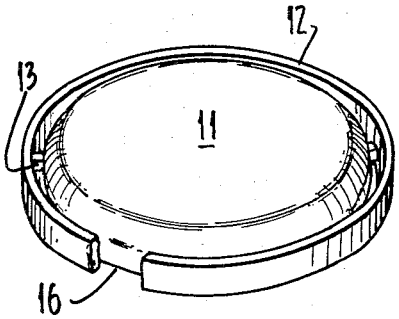
FIG. 6 is a perspective view of a variation to the present invention.

In FIG. 6, the outer wall 12 is discontinuous due to gap 16 which enables the wall strip 12 to be grasped and removed from the closure so that the closure 11 can be removed from the container. The connecting links can be severed by engaging the upper edge of the wall portion 12 and flexing downwards. Standard cap applicators can be used to fit the caps to the containers and a specially designed applicator is not required.

From the above, it can be seen that the present invention provides a unique tamper-proof closure which is simple in design and easy to apply while providing the security of being non-removeable without severing the connection between the outer wall and the side wall of the closure.

I claim:

1. A tamper-proof container comprising a container body having a neck portion, said neck portion incorporating an opening, a peripheral lip about said opening, a recessed portion below said lip and a shoulder portion forming the base of said recess and extending beyond the extremity of said lip; and a closure for said container body comprising a top portion adapted to cover said opening, a first dependent side wall portion adapted to extend over said lip, a flange dependent from said top portion and concentric with and radially spaced from said first wall portion such that said lip of said opening of said container is wedged between said flange and said first dependent wall portion, a beading on said sidewall portions adapted to seat in said recess and a second wall substantially encircling said first wall and having a portion detachably secured to said first side wall, radially spaced therefrom and concentric therewith, said second wall portion seating on said shoulder portion.

2. A container as claimed in claim 1, in which said second wall portion is discontinuous.

3. A closure for use with a tamper-proof container having a body with a neck portion, said neck portion incorporating an opening, a peripheral lip about said opening, a recessed portion below said lip and a shoulder portion forming the base of said recess and extending beyond the extremity of said lip; said closure comprising a top portion adapted to cover said opening, a first dependent side wall portion adapted to extend over said lip, a flange dependent from said top portion and concentric with and radially spaced from said first wall portion such that said lip of said opening of said container is wedged between said flange and said first dependent wall portion, a beading on said sidewall portions adapted to seat in said recess and a second wall substantially encircling said first wall and having a portion detachably secured to said first side wall, radially spaced therefrom and concentric therewith, said second wall portion seating on said shoulder portion.

* * * * *